United States Patent [19]

Long et al.

[11] Patent Number: 4,622,836

[45] Date of Patent: Nov. 18, 1986

[54] LOFT AND LIE CALIBRATION MACHINE

[75] Inventors: Dabbs C. Long, Albany, Ga.; Gerald R. Anderson, York, Pa.; Dale L. Linman, Bloomington, Minn.; Thomas M. Moore, Glen Burnie, Md.

[73] Assignee: MacGregor Golf Company, Albany, Ga.

[21] Appl. No.: 715,699

[22] Filed: Mar. 25, 1985

[51] Int. Cl.[4] ..... B21C 51/00

[52] U.S. Cl. ..... 72/31; 72/293; 72/306; 33/508; 33/534; 33/558

[58] Field of Search ..... 72/34, 293, 316, 31, 72/12, 306; 33/508, 558, 561, 556, 559, 1 N, 534

[56] References Cited

U.S. PATENT DOCUMENTS

| | | | |
|---|---|---|---|
| 1,239,533 | 9/1917 | Sponsel | 72/34 |
| 1,662,465 | 3/1928 | McGee . | |
| 2,973,581 | 3/1961 | Rhodehamel | 33/174 |
| 3,054,190 | 9/1962 | Miller et al. | 33/354 |
| 3,234,655 | 2/1966 | Skeels et al. | 33/356 |
| 3,286,353 | 11/1966 | Potter | 33/356 |
| 3,357,219 | 12/1967 | Hunter | 72/35 |
| 3,439,429 | 4/1969 | Sundstrom | 33/174 |
| 3,943,746 | 3/1976 | Eitel | 72/384 |
| 3,965,714 | 6/1976 | Beard | 72/32 |
| 4,061,006 | 12/1977 | Burns, Jr. | 72/34 |
| 4,094,072 | 6/1978 | Erb | 33/174 |
| 4,122,607 | 10/1978 | Hopf | 33/356 |

FOREIGN PATENT DOCUMENTS

| | | | |
|---|---|---|---|
| 740177 | 10/1943 | Fed. Rep. of Germany | 33/516 |
| 592615 | 5/1959 | Italy | 33/516 |

*Primary Examiner*—Daniel C. Crane

*Attorney, Agent, or Firm*—Dale Lischer; J. Rodgers Lunsford, III

[57] ABSTRACT

A golf club loft and lie calibration machine has a fixture with a cavity that exactly matches the back of the golf club head for clamping the golf club head. A pin with a tapered end is inserted into the bore of the golf club's hosel. The angular displacement of the pin is mechanically converted into two components of angular displacement which components are then converted to electrical signals. The electrical signals are processed to determine the deviations from the specified loft and lie angles. The deviation is used to activate hydraulic rams distributed around the fixture to bend the golf club head's hosel and bring the golf club back to specification.

6 Claims, 8 Drawing Figures

LOFT AND LIE CALIBRATION MACHINE

BACKGROUND OF THE INVENTION

This invention relates generally to machines for detecting and adjusting the loft and lie angles of a golf club head, and more particularly concerns a machine which can measure the loft and lie angles of a golf club head and can automatically adjust the loft and lie angles of the golf club head before the golf club shaft is attached to the head.

Golf club irons typically include a set of nine clubs numbered one through nine, a pitching wedge, and a sand wedge. Each club includes a club head and a shaft which is attached to the club head by fitting the shaft into the bore of a hosel. If the hosel is bored accurately and if the shaft is fit properly, the hosel is concentric with the shaft. The hosel extends downwardly and forms a neck which merges with and is integral with the club head itself. The club head includes a heel, a bottom sole, and a toe. The club has a plane face, which when the club is swung contacts the golf ball, and a back side.

The loft angle of the club is the angle between a vertical plane, which includes the club shaft and the sole of the club, and the plane of the club face. The lie angle of the club is the angle between the club shaft and the ground (horizontal plane) when the sole of the club is flat on the ground and when the club shaft lies in a vertical plane.

The loft angle, as the name suggests, determines how much loft is imparted to the ball when it is struck by the tilted club face. The lie angle of the club assures that, when swung properly, the sole of the club will contact the ground evenly so that the club face will not tend to twist inwardly or outwardly.

Although the loft and lie angles may vary slightly between different brands of clubs, the loft and lie angles (in degrees) for the clubs generally are as follows:

| Club | Loft | Lie |
|---|---|---|
| 1 | 17 | 56 |
| 2 | 21 | 57 |
| 3 | 24 | 58 |
| 4 | 27 | 59 |
| 5 | 31 | 60 |
| 6 | 35 | 61 |
| 7 | 39 | 62 |
| 8 | 43 | 63 |
| 9 | 47 | 63 |
| Pitching Wedge | 51 | 64 |
| Sand Wedge | 55 | 64 |

Of course, the angles can be varied according to the manufacturer's perception of what the buying public expects in club performance in terms of its loft and lie angles. The important consideration for the present invention, however, is not the specific loft or lie angle specified for each club by the manufacturer, but being able to accurately duplicate the assigned angle during the manufacturing process so that each club manufactured to the same specification of loft and lie angles is the same as every other club made to that same specification.

The prior art discloses a number of machines and fixtures for measuring and adjusting the loft and lie angle for a golf club. The prior art patents generally provide for measurement of the loft and lie angles on a club to which the shaft has already been affixed. The extending shaft assures that the measurements made by the prior art machine are accurate even if the bore in the hosel is inaccurately drilled off center or otherwise not true. Obviously, in the manufacturing process, it is desirable to measure and adjust the loft and lie angles of the club head before the shaft is inserted in the bore and affixed to the club head. If the shaft is affixed before measurement and adjustment, club heads that are so out of specification that they cannot be brought back to specification, require the manufacturer to scrap the entire club including the shaft as opposed to simply scrapping a single club head.

The prior art also shows a variety of means for clamping the golf club during measurement and subsequent adjustment of the loft and lie angles. Obviously to insure accurate, reproducible measurement and adjustment, the golf club must be accurately and securely fixed during measurement and adjustment of the loft and lie angles.

The prior art Beard U.S. Pat. No. 3,965,714 shows calibration machine for the loft and lie angles of a finished club. The club face is clamped against the flat side of a fixture by means of a wedge-shaped block which engages the back of the club head. A wrench-like device is attached around the hosel of the club and has one end attached to a hydraulic cylinder. A lie indicator gauge is then attached to the club shaft to measure the lie angle. If the lie angle is out of specification, the cylinder is activated to bend the club head hosel, and the lie angle is again measured by the lie angle gauge attached to the club shaft. Once the lie angle has been set, the hydraulic cylinder and wrench are rotated ninety degrees, and the loft angle is measured by the position of the fixture vis-a-vis the extension of the club shaft parallel to the fixture. Again the hydraulic cylinder, after being rotated ninety degrees, is used to bend the hosel to the appropriate position to establish the appropriate loft angle.

The Sundstrom U.S. Pat. No. 3,439,429 discloses a loft and lie calibration machine in which the club is secured in a fixture by means of a hydraulically controlled lever and shoe mechanism which engages the back of the club head. A scale extends above the fixture and is moveable in order to allow the same scale to measure both the loft and lie angles of the club with respect to the extension of the club shaft. Adjustment of the loft and lie angle is done by means of a manual wrench which can be attached to the hosel of the club.

The prior art calibration machines generally operate on finished clubs with a shaft affixed. By having the shaft affixed, loft and lie angles can be accurately measured and adjusted even if the bore of the hosel is not true. Moreover, the prior art loft and lie calibration machines do not allow for simultaneous measurement of the loft and lie angles and nearly simultaneous adjustment of the loft and lie angles. Furthermore, the prior art clamping mechanisms in general provide a flat fixed block which engages the flat face of the club and some sort of wedge or shoe mechanism to engage the uneven back side of the club in order to secure the club to the block. While such engagement may be adequate for purposes of measuring and adjusting the loft angle, the club head may still rock slightly on the sole, thus adversely affecting consistent lie angle measurement and adjustment.

SUMMARY OF THE INVENTION

It is therefore an object of the present invention to provide a loft and lie calibration machine which can measure the loft and lie angles of a club head before the club shaft is attached to the club head by measuring the angular orientation of the bore of the hosel and thereby compensating for an inaccurately bored hosel.

It is also an object of the present invention to provide a loft and lie calibration machine which can simultaneously measure deviations of the loft and lie angles of a club head from the specified loft and lie angles for the particular club head.

It is also an object of the present invention to provide hydraulic adjustment means which in response to the measured loft and lie angles are activated to engage the hosel of the club head and to adjust the hosel in accordance with the previously measured loft and lie angles.

It is an additional object of the present invention to provide a clamping block for the club head which has a removable insert that precisely conforms to the back of the club head so that when a flat wedge engages the face of the club head, the club head is oriented in a predetermined fashion and is secured within the clamping block from movement during the measurement and adjustment procedure of the loft and lie calibration machine.

In order to accomplish the objects of the present invention, the golf club head without a shaft is mounted in a fixture which includes a fixed block, a rotatable internal shell within the block, and a shell insert having a cavity which precisely conforms to the contour of the back of the golf club head. There is a separate insert for each golf club head and the insert is mounted in the rotatable shell so that the lie angle is properly established. By rotating the rotatable shell of the fixture, the loft angle can be established.

Once the club has oeen nested into the cavity in the insert within the rotatable shell and the shell has been rotated and locked to the block, a flat wedge engages the plane club face and clamps the club head into place. With the club head thus clamped in the fixture, the bore of the hosel should be exactly vertical for a properly calibrated club.

A tapered pin is inserted into the bore of the hosel and extends co-axially from the bore. The tapered pin is connected to an angle measurement device which includes a converter mechanism whicn converts the angular displacement of the pin into two components of angular displacement. The two components of angular displacement are then resolved by means of a computer into the measured loft and lie angles for the club head. The measured loft and lie angles are compared by the computer to the predetermined, specified loft and lie angles and a deviation is calculated which deviation is related to the amount that loft and/or lie angles are out of specification. The deviation information is then used to activate one or more of four hydraulic cylinders positioned around the hosel in order to bend the hosel back toward the vertical orientation. Once the cylinders have extended, bent the hosel as required, and have retracted, the loft and lie angles are again measured and further adjustment is undertaken if required.

As a result, the loft and lie angles of golf club heads can be measured and adjusted prior to the time consuming and expensive process of inserting and affixing the shaft into the club head hosel. Therefore, if a golf club head is so far out of specification that it cannot be bent back to specification, the club head can be scrapped without the necessity of either scrapping the shaft which has been attached to the golf club head or of recovering the shaft.

Also by a minor modification to the converter mechanism, the converter mechanism can be connected directly to the shaft of a golf club, and a finished golf club can be calibrated as well.

Other objects and advantages of the invention will become apparent upon reading the following detailed description and upon reference to the drawings.

DETAILED DESCRIPTION OF THE INVENTION

While the invention will be described in connection with the preferred embodiment, it will be understood that we do not intend to limit the invention to that embodiment. On the contrary, we intend to cover all alternatives, modifications, and equivalents as may be included within the spirit and the scope of the invention as defined by the appended claims.

Figure 7:
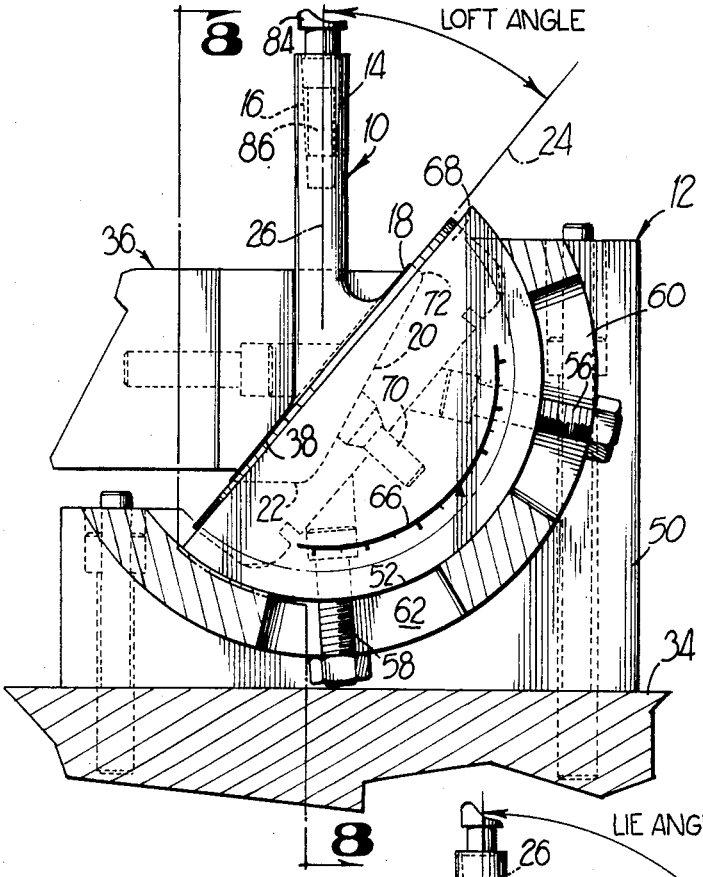
FIG. 7 is a section view taken along ling 7—7 of FIG. 8 of the fixture which holds the golf club head in place during measurement and adjustment.
Figure 8:
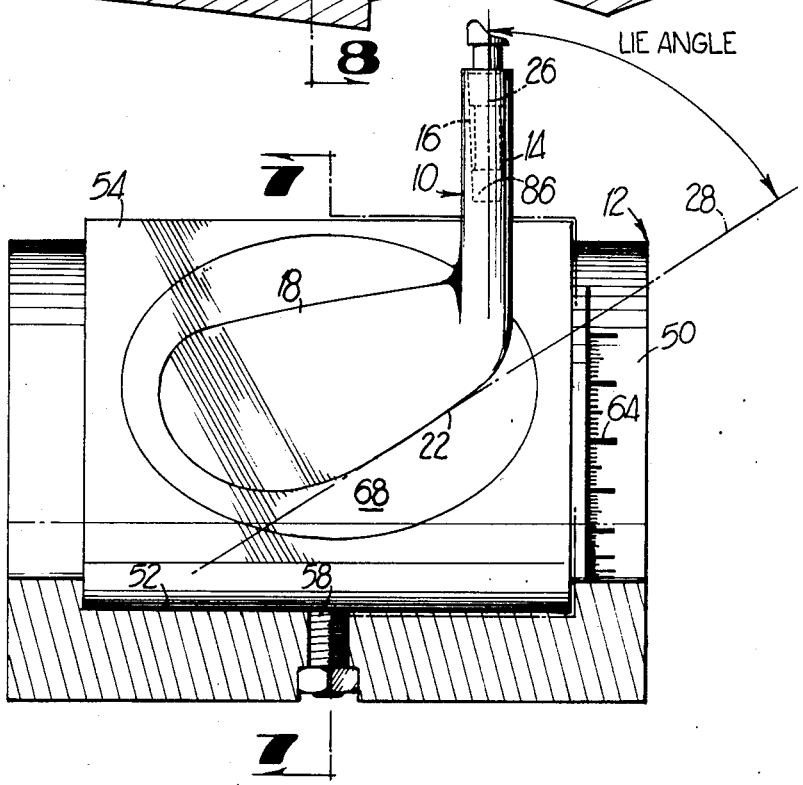
FIG. 8 is a section view taken along line 8—8 of FIG. 7 of the fixture.

Turning first to FIGS. 7 and 8, there is shown a golf club head 10 mounted within a fixture 12 which will be described in greater detail below. The golf club head 10 includes a hosel 14 having an internal taper bore 16 into which a golf club shaft (not shown) is fitted. The golf club head also includes a planar face 18, a back side 20, and a sole 22. FIG. 7 illustrates the loft angle for the golf club head. The loft angle is the angle between the extended plane (line 24) of the club face 18 and the golf shaft which is illustrated by the center line 26 of the bore 16 in the hosel 14.

The lie angle is illustrated in FIG. 8 and is the angle between the plane (line 28) of the club sole and the club shaft as illustrated by the center line 26 of the internal bore 16. The plane 28 corresponds to the ground when the club is properly grounded prior to hitting a golf ball.

As previously stated, the loft and lie angles for each of the numbered golf irons is specified by the manufacturer in accordance with the manufacturer's concept of what loft and lie angles provide the most appropriate performance for the particular golf club iron. The important consideration is that for each of the subsequent golf clubs that is manufactured, those clubs conform to the loft and lie angles specifications so that production is consistent. Also, as previously stated, it is important to be able to measure and adjust the loft and lie angles of the golf club before the shaft is affixed to the golf club so that if a particular golf club head cannot be brought back into specification, there will be no necessity of scrapping the entire club, only the rejected golf club head.

Accordingly, we have found that in order to accurately measure the loft and lie angles of a golf club head, it is necessary to measure the angular orientation of the center of the internal bore of the golf club hosel instead of measuring the angular orientation of the outside of the hosel. If for example the internal bore is off-center of the hosel, measuring the angular orientation of the hosel itself will not assure that the shaft when inserted in the internal bore will be in the proper orientation for the measured loft and lie angles.

Figure 1:
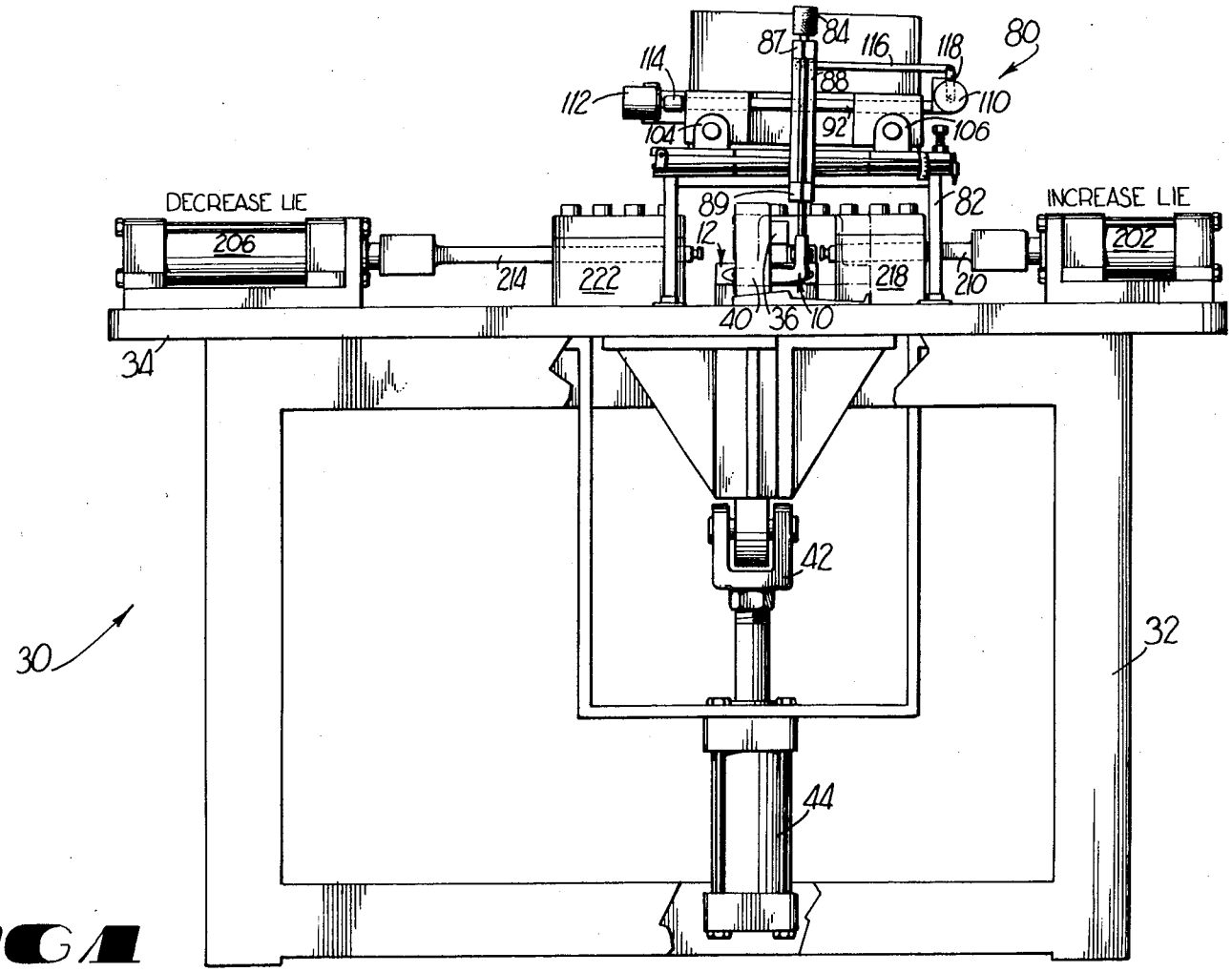
FIG. 1 is a front elevation view of the loft and lie angle measurement and adjustment machine of the present invention.

In order to calibrate golf club heads (measure the loft and lie angles and adjust the loft and lie angles), there is shown in FIG. 1 a loft and lie calibration machine 30 which includes a base stand 32 and a working top 34.

Figure 3:
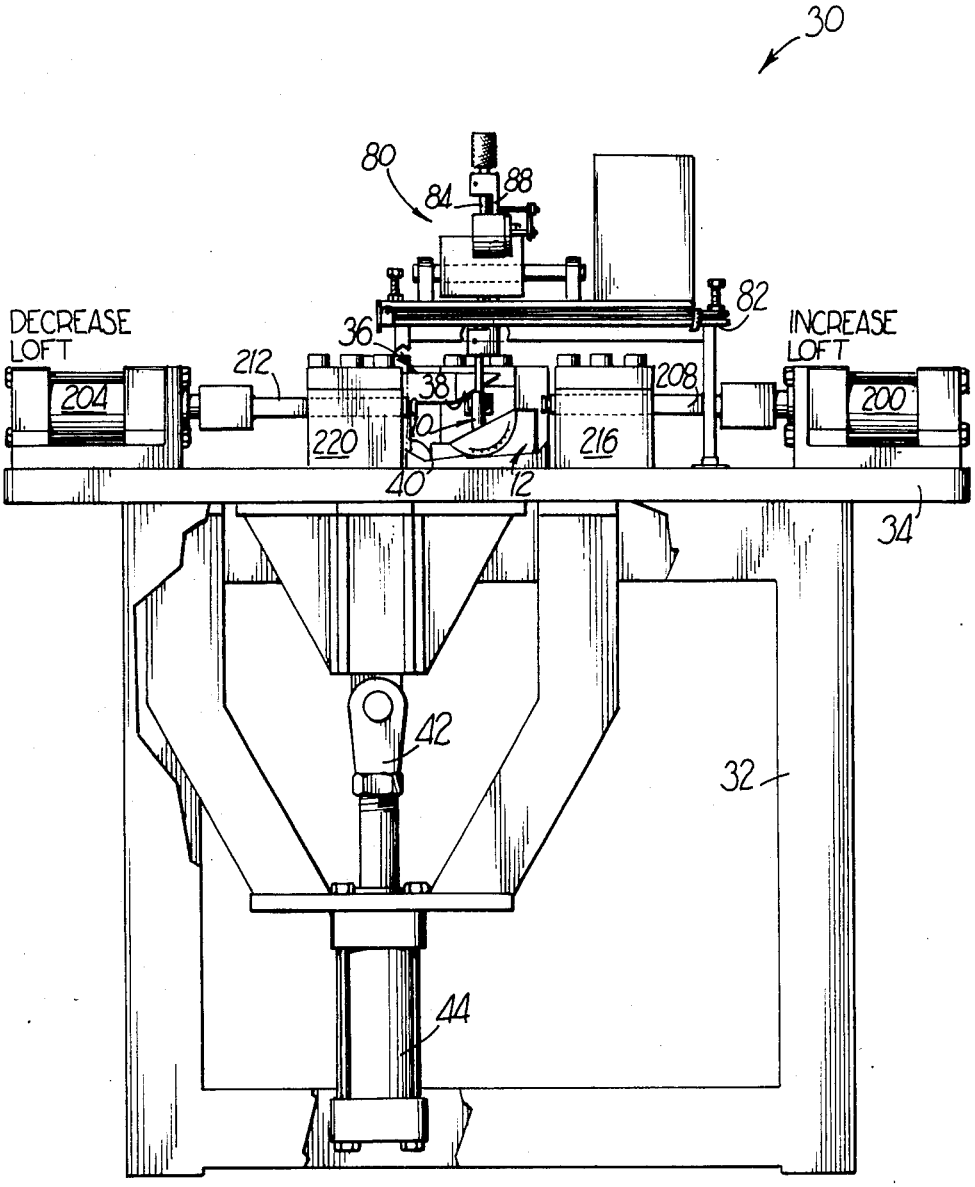
FIG. 3 is a side elevation view of the machine.
Figure 4:
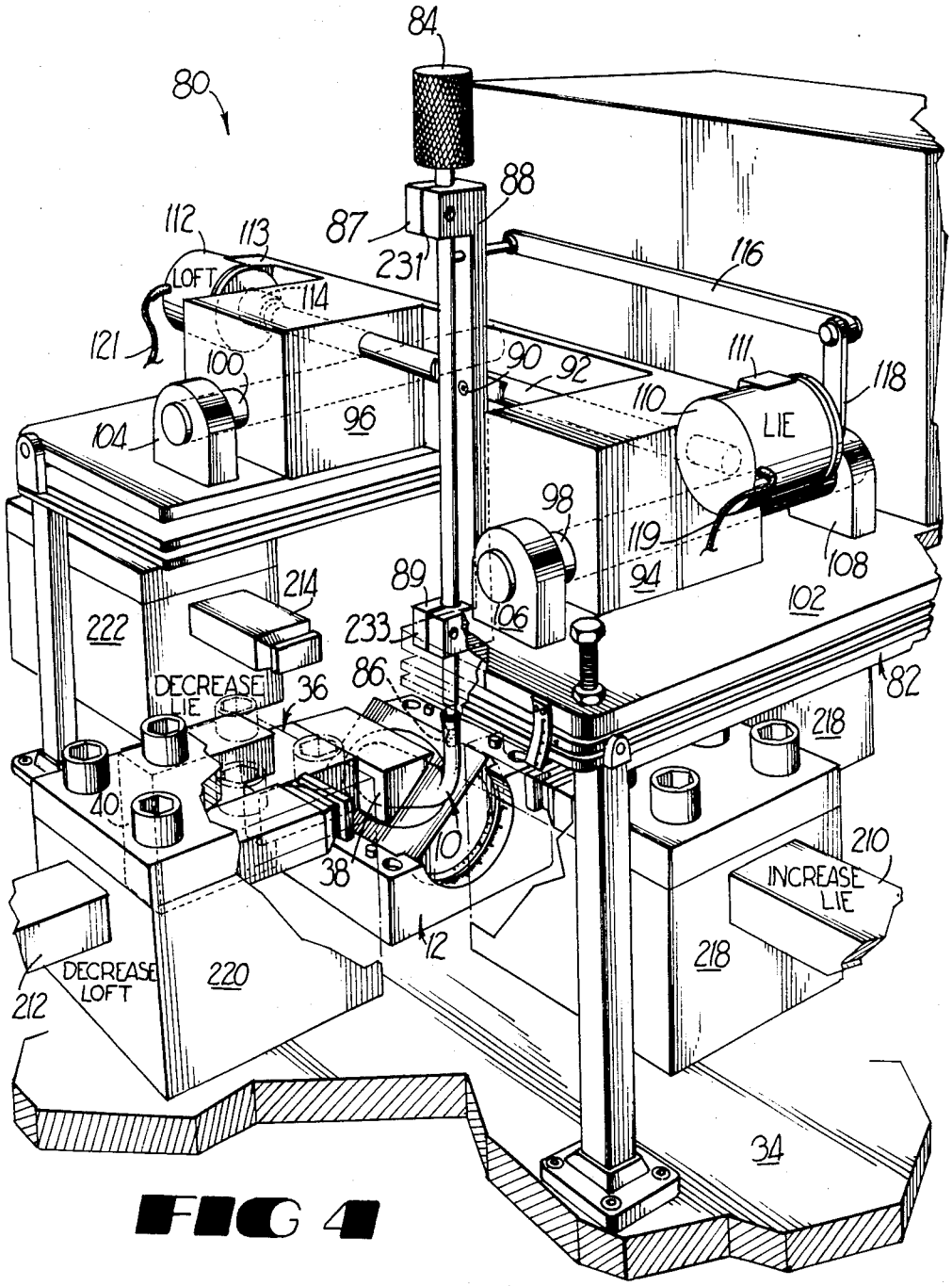
FIG. 4 is a perspective view of the angle measurement device used to measure the loft and lie angles of the golf club head.

A fixture 12 for holding the golf club head 10 is securely mounted to the working surface 34 of the loft and lie calibration machine 30. A clamp means 36 is provided to secure the golf club head 10 to the fixture 12. The clamp means 36 includes a wedge portion 38 (FIGS. 3, 4, and 7) and an integral shank portion 40 which is connected by means of yoke 42 to a hydraulic cylinder 44. When the hydraulic cylinder 44 retracts, the shank 40 moves the wedge surface 38 downward into engagement with the plane face 18 of the golf club thereby clamping the golf club head 10 into the fixture 12. When the cylinder 44 is extended, the shank along with the integral wedge surface 38 is moved upward disengaging the wedge surface 38 from the plane face 18 of the golf club head, thereby allowing removal of the golf club head 10 from the fixture 12.

In accordance with the present invention, the fixture 12, which is illustrated in greater detail in FIGS. 7 and 8, assures that the clamping means 36 with the wedge surface 38 secures the golf club head in the proper orientation for measurement and adjustment of the loft and lie angles. In that regard, the fixture 12 comprises a fixed block 50 that has a concave opening 52 within which is mounted a rotatable shell 54. The shell 54 is locked to the fixed block by means of bolts 56 and 58 which extend through slots 60 and 62 in the fixed block 50.

A scale 64 is inscribed on the surface of the opening 52 and a corresponding scale 66 is inscribed on the rotatable shell 54. The scales 64 and 66 allow the rotatable shell 54 to be set at a precise angle with respect to the vertical. As a result, for a particular specified loft angle, the rotatable shell 54 can be rotated into a position to correspond to that specified loft angle which is indicated by the scales 64 and 66.

In order to secure the club 10 in the fixture 12, an insert 68 is locked into the rotatable shell 54 by means of set screw 70. The insert 68 is oval in shape, and it fits into an oval opening in the rotatable shell 54. Consequently, the insert 68 is always oriented in a predetermined fashion with regard to the shell 54 and with regard to the fixture 12. The insert 68 has a cavity 72 which cavity exactly conforms to the contour of the back side 20 of one of the numbered golf club heads in a set of clubs. Because each numbered golf club head has a back side that is slightly different in contour, there are a number of inserts 68, each one conforming to a particular numbered golf club head. With the insert 68 locked into the oval opening, the cavity 72 is always oriented so that the plane 28 of the sole of the club is always displaced from the vertical by the specified lie angle.

Once the club is securely nested and clamped in the cavity 72 of the insert 68 and the shell 54 is rotated and located at the specified left angle, the center line of the bore 16 of the club will be precisely vertical (zero or reference position) if the club has the specified loft and lie angles.

In order to measure the loft and lie angles, an angle measurement device 80 is mounted on a tiltable table 82 above the fixture 12. The tiltable table can be tilted in order to provide initial set up and calibration of the angle measurement device 80. The angle measurement device 80 can best be seen in FIG. 4 and includes a pin 84 having a tapered end 86 which is insertable in the tapered bore 16 of the hosel 14 (see FIGS. 7 and 8). Returning to FIG. 4, the pin 84 is slidably mounted in brackets 87 and 89 of arm 88 which is rotatably connected at a pivot point 90 to a shaft 92. The shaft 92 is slidably and rotatably supported by bearing blocks 94 and 96, which in turn are slidably mounted on rods 98 and 100. The rods 98 and 100 are supported on the top surface 102 of the adjustable table 82 by means of brackets 104, 106, 108, and 109 (shown in FIG. 5). Because the shaft 92 can slide left and right and the bearing blocks 94 and 96 can slide forward and back, the pin 84 can move with two degrees of linear freedom and be positioned above the hosel bore.

Figure 5:
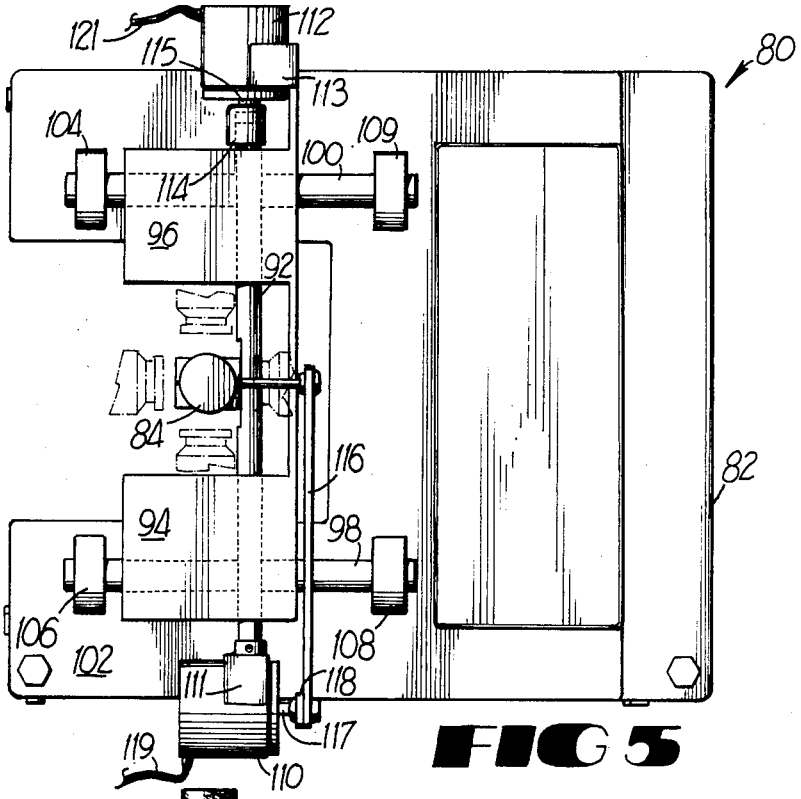
FIG. 5 is a top plan view of the angle measurement device.
Figure 6:
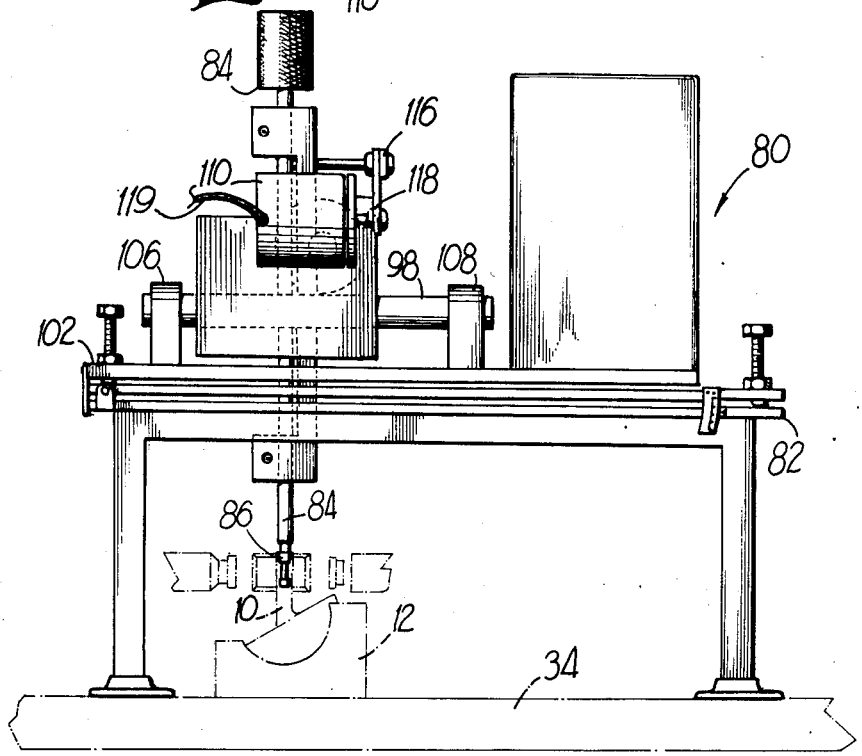
FIG. 6 is a side elevation view of the angle measurement device.

A pulse counter 110 has its housing rigidly attached by means of bracket 111 (FIG. 5) to one end of the rotatable shaft 92. A second pulse counter 112 has its housing rigidly attached to bearing block 96 by means of bracket 113 (FIG. 5).

The input shaft 115 of pulse counter 112 is slidably connected to shaft 92 by means of splined connector 114. The input shaft 117 of pulse counter 110 is connected to crank 118 which is in turn connected to arm 88 by means of push bar 116. Push bar 116 is pivotally connected to crank 118 at its one end and to arm 88 at its other end.

The pulse counters 110 and 112 are standard pulse counters which produce a series of electrical pulses at electrical outputs 119 and 121 respectively in response to the rotation of their input shafts. As a result, the output signals of the pulse counters are electrical representations of the angular displacement of the input shafts of the pulse counters. A pulse counter which is useful in connection with the present invention is Model DRC-152 manufactured by Dynamics Research Corporation of Wilmington, Massachusetts.

The arm 88, the shaft 92, the push bar 116, and the crank 118 provide a mechanical converter which converts angular displacement of the pin 84 from the vertical (reference position) into two components of angular displacement, one representing the deviation of the measured lie angle from the specified lie angle and one representing the deviation of the measured loft angle from the specified loft angle.

In operation the pin 84 is positioned above the bore 16 by sliding the shaft 92 left or right within bearing blocks 94 and 96 and by sliding the bearing blocks forward or backward on rods 98 and 100. Once the pin 84 is inserted into the bore 16, any angular deviation of the bore from vertical (reference position) is imparted to the pin 84 and its attached arm 88. Arm 88 has two degrees of angular freedom, i.e. left or right for the lie angle deviation and forward or backward for the loft angle deviation. When arm 88 is angularly displaced from the vertical to the left or right (lie angle deviation), arm 88 pivots about pivot point 90 which causes push bar 116 to move crank 118 and rotate input shaft 117 of pulse converter 110. When arm 88 is angularly displaced from the vertical to the front or back (loft angle deviation), shaft 92 is rotated along with input shaft 115 of pulse converter 112.

The first component of angular displacement (the lie angle deviation) is represented by the angular displacement of the input shaft 117 of pulse converter 110, and the second component of angular displacement (the loft angle deviation) is represented by the angular displacement of the input shaft 115 of pulse converter 112. Those two angular displacement components at the inputs to pulse counters 112 and 110 produce proportional electrical signals representing the amount the loft angle and the lie angle each deviates (plus or minus in 0.3 degree increments) from the zero position (vertical), which zero position corresponds to the specified loft angle and lie angles for the club being calibrated.

Brackets 87 and 89 of arm 88 may be modified so that they are hinged in order to open at lines 231 and 233. With brackets 87 and 89 thus modified, the angle measurement device may be used to calibrate finished golf clubs with the shaft affixed. The finished golf club is clamped in fixture 12, and the bearing blocks 94 and 96 are slid forward on rods 98 and 100 until the modified hinged brackets 87 and 89 engage the shaft of the finished club. The hinged brackets 87 and 89 are then closed upon the club shaft, and the angular displacement of the club shaft is converted into electrical signals representing the lie angle and loft angles at the outputs of pulse counters 110 and 112 respectively.

The electrical signals produced by the pulse counters which represent deviations of the loft and lie angles from the vertical (zero position) are then fed to a microcomputer which, in accordance with programs and calculations well known in the art, produces control signals to activate selectively the adjustment means of the loft and lie calibration machine.

Figure 2:
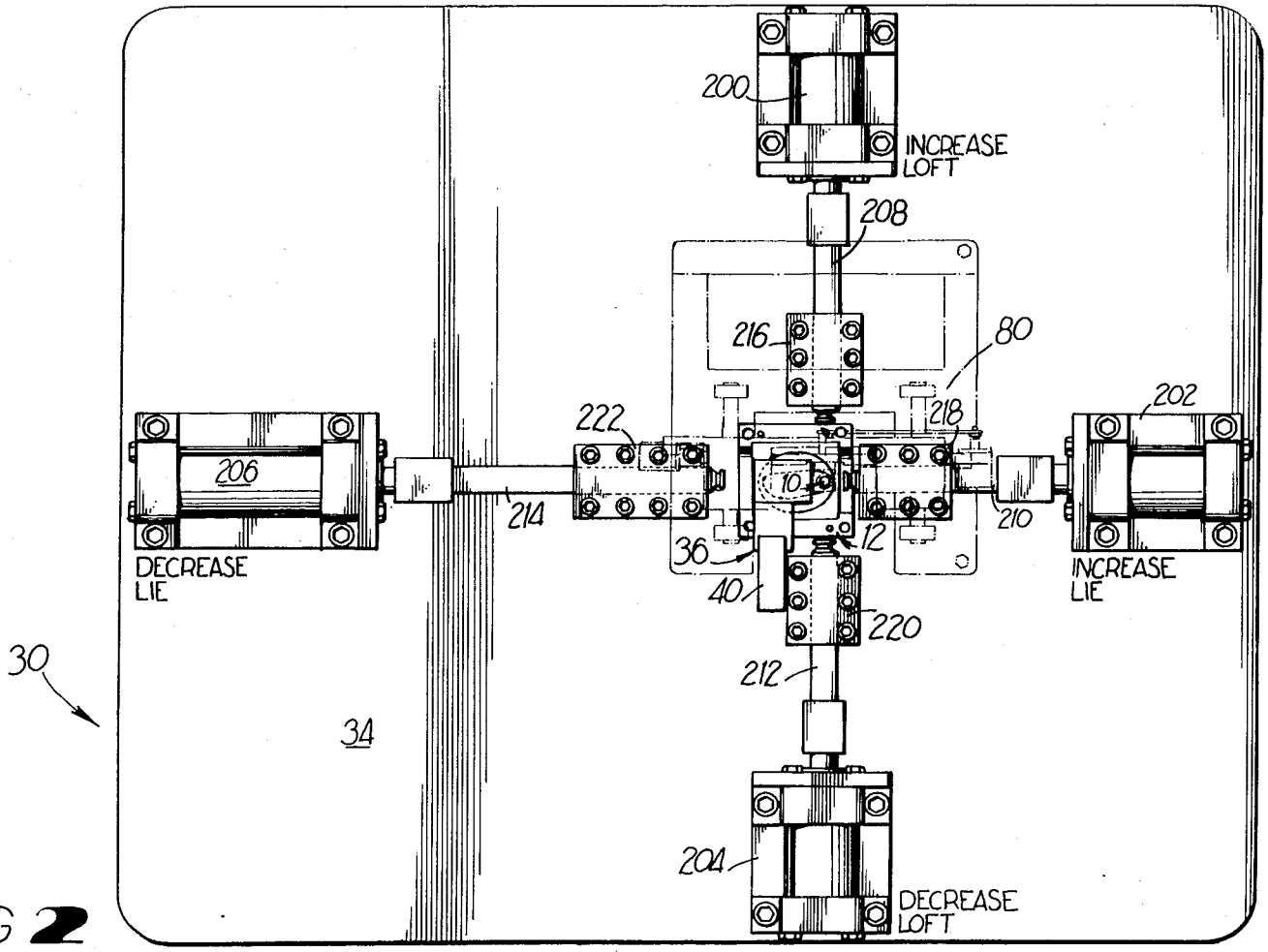
FIG. 2 is a top plan view of the machine.

Turning to FIG. 2, the adjustment means comprises four hydraulic cylinders 200, 202, 204, and 206 mounted on the surface 34 of the loft and lie calibration machine 30. The adjustment cylinders are spaced around the fixture 12 at 90 degree spacings. Each of the cylinders 200, 202, 204, and 206 has attached to it a ram 208, 210, 212, and 214 respectively which are respectively slidably disposed within support blocks 216, 218, 220 and 222. The support blocks are securely attached to the working surface 34 to assure that the rams 208, 210, 212, and 214 are properly aligned with the position of the hosel of the club clamped in the fixture 12.

Cylinder 200 extends ram 208 to increase the loft angle of the club head. Cylinder 202 extends ram 210 to increase the lie angle of the club head. Cylinder 204 extends ram 212 to decrease the loft angle of the club head. Cylinder 206 extends ram 214 to decrease the lie angle of the club head. The adjustment cylinders are selectively activated by the microcomputer in accordance with the measured angular deviation. Accordingly, the rams selectively exert forces on the hosel 14 to bend it and to bring the club back into specification.

In order to overcome the resilience of the hosel and assure that the hosel does not spring back and out of specification after being selectively bent by the rams, the rams overshoot the zero point (vertical). The amount of overshoot is established by a time delay between the time the hosel passes through the zero point (vertical) and the time the ram retracts. In the preferred embodiment the time delay is 0.04 second. Each cylinder has a needle valve bleed in the cylinder cushion to control the ram's speed. By adjusting the needle valves during initial set up of the machine, the amount of overshoot can be set for the material and resilience of particular club heads being calibrated.

We claim:

1. A loft and lie calibration machine for measuring and adjusting the loft and lie angles with respect to specified loft and lie angles for a golf club head having a face, a back side, and a hosel with a bore therein, comprising:

a. a fixture secured to a planar base and having a cavity that conforms to the back side of the golf club head to be calibrated;

b. clamp means for engaging the face of the club head to secure the golf club head in the cavity;

c. angle measurement means mounted in fixed relationship to the base and attached fixture for determining measured loft and lie angles of the club head, the angle measurement means ccomprising:

i. a pin insertable into the bore and extending coaxially from the bore;

ii. converter means attached to the pin which converter means converts the pin's angular orientation with respect to the base into two rotational components, the first rotational component being proportional to the measured loft angle and the second rotational component being proportional to the measured lie angle; and iii. computer means for resolving the two rotational components into measured loft and lie angles, comparing the measured loft and lie angles to the specified loft and lie angles, and calculating a deviation therefrom; and d. adjustment means mounted on the base and distributed around the fixture which adjustment means under control of the computer means selectively engage the hosel of the golf club head and, in response to the deviations, exert selective force on the hosel to bend it to eliminate the deviations.

2. The loft and lie calibration machine of claim 1, wherein the converter means comprises a shaft rotatably mounted on the angle measurement means and moveable on the angle measurement means in two degrees of linear freedom parallel to the base with the pin attached to the shaft at a first pivot point and a bar connected at its one end to the pin at a second pivot point displaced from the first pivot point and connected at its other end to crankshaft means, wherein the rotation of the shaft and crankshaft are the two rotational components.

3. A loft and lie calibration machine for measuring loft and lie angles with respect to specified loft and lie angles for a golf club having a shaft and a golf club head, the club head including a face, a back side, and a hosel with a bore therein in which the shaft is secured, comprising:

a. a fixture secured to a planar base and having a cavity that conforms to the back side of the golf club head to be calibrated;

b. clamp means for engaging the face of the club head to secure the golf club head in the cavity;

c. angle measurement means mounted in fixed relationship to the base and attached fixture for determining measured loft and lie angles of the club head, the angle measurement means comprising:

i. converter means attached to the shaft of the club by means of brackets which converter means converts the shaft's angular orientation with respect to the base into two rotational components, the first rotational component being proportional to measured loft angle and the second rotational component being proportional to the measured lie angle; and ii. computer means for resolving the two rotational components into measured loft and lie angles, comparing the measured loft and lie angles to the specified loft and lie angles, and calculating a deviation therefrom; and d. adjustment means mounted on the base and distributed around the fixture which adjustment means under control of the computer means selectively engage the hosel of the golf club head and, in response to the deviations, exert selective force on the hosel to bend it to eliminate the deviations.

4. The loft and lie calibration machine of claim 3, wherein the converter means comprises a shaft rotatably mounted on the angle measurement means and moveable on the angle measurement means in two degrees of linear freedom parallel to the base with the arm attached to the shaft at a first pivot point and a bar connected at its one end to the arm at a second pivot point displaced from the first pivot point and connected at its other end to crankshaft means, wherein the rotataion of the shaft and crankshaft are the two rotational components.

5. A device for measuring the angular orientation of a bore in a workpiece which is fixed to a planar base with respect to a reference position on the base comprising:

a. a shaft rotatably mounted adjacent the base and movable in two degrees of linear freedom parallel to the base;

b. a pin attached to the shaft at a first pivot point, the pin having two degrees of angular freedom with respect to the base and being insertable into the bore;

c. a bar connected at its one end to the pin at a second pivot point displaced from the first pivot point and connected at its other end to a crankshaft, d. computer means for resolving the rotation of the shaft and rotation of the crankshaft into two measured angles relating to and components of the pin's angular orientation with respect to the reference position.

6. A device for measuring the angular orientation of a rod fixed to a planar base with respect to a reference position on the base comprising:

a. a shaft rotatably mounted adjacent the base and movable in two degrees of linear freedom parallel to the base;

b. arm means clamped to and extending along the rod, the arm means being attached to the shaft at a first pivot point and having two degrees of angular freedom with respect to the base;

c. a bar connected at its one end to the arm at a second pivot point displaced from the first pivot point and connected at its other end to a crankshaft, d. computer means for resolving rotation of the shaft and rotation of the crank shaft into two measured angles relating to and components of the rod+s angular orientation with respect to the reference position.

* * * * *